US005391100A

United States Patent [19]

Maruyama et al.

[11] Patent Number: 5,391,100

[45] Date of Patent: Feb. 21, 1995

[54] METHOD OF MANUFACTURING OF SPARK PLUG CAP WITH IGNITION VOLTAGE DETECTIVE CAPACITOR

[75] Inventors: Shigeru Maruyama; Yuichi Shimasaki; Masaki Kanehiro; Takashi Hisaki; Shigeki Baba; Takuji Ishioka; Jiro Takagi; Eitetsu Akiyama, all of Saitama, Japan

[73] Assignee: Honda Giken Kogyo Kabushiki Kaisha, Tokyo, Japan

[21] Appl. No.: 149,647

[22] Filed: Nov. 9, 1993

[30] Foreign Application Priority Data

Nov. 10, 1992 [JP] Japan ..... 4-326165
Nov. 10, 1992 [JP] Japan ..... 4-326168

[51] Int. Cl.[6] ..... F02P 17/00

[52] U.S. Cl. ..... 445/7; 324/402; 324/126

[58] Field of Search ..... 445/7, 3; 324/126, 402

[56] References Cited

U.S. PATENT DOCUMENTS 3,538,440 11/1970 Galloway ..... 324/126 X
4,041,373 8/1977 Maringer ..... 324/126 X
4,052,665 10/1977 Gruenwald ..... 324/402 X
4,825,167 4/1989 Bayba ..... 324/402 X
5,145,433 9/1992 Yagi et al. ..... 445/22 X

FOREIGN PATENT DOCUMENTS 52-118135 10/1977 Japan .
96661 4/1990 Japan ..... 324/126
5-65868 3/1993 Japan .

*Primary Examiner*—Kenneth J. Ramsey
*Attorney, Agent, or Firm*—Nikaido, Marmelstein, Murray & Oram

[57] ABSTRACT

A method of manufacturing a spark plug cap covering a spark plug for an internal combustion engine, equipped with an ignition voltage detective capacitor having a first conductor housed in a cap body for carrying an ignition voltage produced by an ignition coil to the spark plug and a second conductor located keeping a predetermined distance from the first conductor while sandwiching an insulative material such that the capacitor is formed between the first and second conductors for detecting the ignition voltage. The method comprises separately fabricating said insulative body and a member from the insulative material embedding said second conductor therein and fixing the member at said insulative body such that said detective capacitor is formed. The second conductor may be formed in the shape of a plate to be wound around the cap body.

30 Claims, 16 Drawing Sheets

METHOD OF MANUFACTURING OF SPARK PLUG CAP WITH IGNITION VOLTAGE DETECTIVE CAPACITOR

BACKGROUND OF THE INVENTION

1. Field of the Invention

This invention relates to a method of forming a spark plug cap with a capacitor for detecting ignition voltage, more particularly to a method for forming such a spark plug cap with a capacitor for use in detecting misfire occurring during operation of a gasoline engine or other spark-ignition type internal combustion engine.

2. Description of the Prior Art

As is well known, in gasoline and other spark plug ignition combustion engines a high voltage produced by an ignition coil is supplied to the spark plugs at the engine cylinders. At each cylinder, the resulting spark discharge between the spark plug electrodes produces a spark which ignites an air-fuel mixture that has been drawn into the cylinder, causing the mixture to burn explosively. In the course of this ignition-combustion process in the internal combustion engine, the mixture may for some reason occasionally fail to burn properly. This is referred to as a misfire. Misfires can result from causes in either the fuel supply system or the ignition system. Misfires caused by problems in the fuel supply system are the result of an overly lean or overly rich air-fuel mixture. In that case, a spark is produced between the spark plug electrodes but the air-fuel mixture does not ignite. Misfires caused by problems in the ignition system are the result of spark plug electrode fouling or ignition circuit malfunctions which prevent normal spark discharge.

The occurrence of misfire in the course of engine operation not only degrades driving performance but also lowers fuel efficiency and may cause after-firing of unburned gases in the exhaust system, which can damage the exhaust gas after-treatment system and have other adverse effects. Moreover, since the occurrence of even a single misfire indicates a misadjustment or malfunction in the fuel supply or ignition system, prompt elimination of the problem is essential. Because of this, there is a strong need for development of a system for detecting misfires as soon as they occur.

One type of misfire detector that has been proposed is the mis-spark detector described in Japanese Laid-Open Patent Publication No. 52(1977)-118135. As shown in FIG. 21, the detector includes a conductor 51 wrapped around a portion of a high-voltage cable 50 of the engine ignition system so as to constitute a detective capacitor 52 (a type of capacitance probe) in which the insulation cladding 50A of the high-voltage cable 50 serves as the dielectric. A voltage divider capacitor 53 is connected between the capacitor 52 and the ground so that the ignition voltage (secondary voltage of the ignition coil) applied to the conductive core 50B of the high-voltage cable 50 induces a voltage across the terminals of the capacitor 52 owing to its static capacitance. The induced voltage is statically divided by the detection capacitor 52 and the divider capacitor 53, and the voltage across the terminals of the divider capacitor 53 (the divided voltage) is forwarded as a detection voltage to an electronic circuit 54 for processing and discrimination. The electronic circuit 54 detects the occurrence of misfires from the difference between the wave form of the ignition voltage at the time of normal spark discharge and that at the time of no spark discharge (missparking). Among the different types of misfires, the detector thus detects misfires that occur when no spark discharge is produced owing to a problem in the ignition system.

Another detector for detecting misfire in internal combustion engines is disclosed in the assignee's Japanese Laid-Open Patent Publication No. 5(1993)-65868. In this detector, the ignition voltage is similarly detected from a high-voltage cable or the like of the ignition system using static voltage division, and misfire owing to causes in the fuel supply system is detected based on the fact that, even when spark discharge occurs, the wave form of the ignition voltage differs between the case where normal combustion occurs and the case where it does not.

Thus in conventional misfire detectors, such a capacitance probe is used as a means for detecting ignition voltage. The probe is constituted by wrapping a sheet or ribbon of conductor around the high-voltage cable of the ignition system so as to form a detective capacitor between the conductor and the core of the high-voltage cable using the insulation cladding of the high-voltage cable as the dielectric. However, the capacitance probe constituted in this manner has a major drawback that derives from the nature of the high-voltage cable of the ignition system. Because of its flexibility and elasticity, the high-voltage cable is highly susceptible to vibration. It is also easily affected by changing ambient humidity, wetting by leaking water, and fouling with oil, grime and the like. When a capacitor for use in detection is formed by wrapping a conductor ribbon around the cable, the static capacitance of the capacitor is apt to be changed from its proper value by a shifting of the conductor caused by vibration as well as by changing humidity, wetting with water and fouling with oil, grime and the like. Although some change in static capacitance can be tolerated if the capacitor is to be used only for checking the ignition voltage, even slight changes have to be avoided when it is used for misfire detection because such detection generally requires accurate detection not only of the ignition voltage but also of the ignition voltage wave form. The capacitance changes to which the prior art capacitance probe is susceptible may alter the detected voltage wave form and thereby make it impossible to detect misfire with high reliability.

In actual practice, moreover, the flexibility and elasticity of the high-voltage cable make the work of attaching the conductor for forming the capacitor on the insulation cladding of the high-voltage cable and securing it thereon difficult and troublesome. Maintenance of the so-formed capacitor is also troublesome.

In addition, the insulation cladding of the high-voltage cable is generally formed of synthetic rubber, a material that is readily degraded when exposed to heat and/or fouled with oil and grime. This degradation of the insulation cladding after the detective capacitor has been formed by winding the conductor around the high-voltage cable not only produces a progressive change in the static capacitance of the capacitor over time but may also reduce the electric insulation strength of the cladding to the point that the high ignition voltage can leak to the conductor wrapped around it. When this happens, the high leak voltage is apt to be conducted to the electronic circuitry of the misfire detector, which it can damage or cause to malfunction. Ideally, moreover, for enabling accurate detection of the ignition voltage wave form, the distance between the conductor and the conductive core constituting the opposite sides of the detection capacitor should be made as small as possible so as to increase its static capacitance. In actuality, however, the conductor and the cable conductive core have to be spaced at a greater distance than desirable as a precaution against loss of the insulation property in the cable cladding owing to the aforesaid causes as well as to corona discharge. As a result, it has been impossible to avoid low accuracy in detecting the ignition voltage wave form.

For overcoming these problems, in Japanese Patent Application 4(1992)-56395; also filed in the United States on Feb. 2, 1993 under the number of 08/012524, the assignee proposed a capacitor for ignition voltage detection in which the conductor is provided in a spark plug cap inserted into the secondary circuit of the ignition system. The ignition plug cap is fixed to cover the terminal portion of an internal combustion engine spark plug. It is equipped with a high-voltage conductor for conducting high voltage for spark discharge to the terminal portion and the high-voltage conductor is enclosed with an insulator. A conductor for detecting ignition voltage is provided integrally with the insulator at a prescribed distance outward from the surface of the high-voltage conductor.

With this configuration, since the detective conductor constituting a part of the detective capacitor for detecting the ignition voltage is provided integrally with the structurally sturdy insulator of the spark plug cap, it has excellent structural durability. Moreover, differently from the case where the detective conductor is provided on a high-voltage cable of the ignition system as in the conventional arrangement, there is no danger of the position of the detection conductor shifting because of mechanical vibration or of it being affected by changes in the ambient humidity, wetting by leaking water or fouling with oil or grime. Since it is therefore possible to prevent such causes from producing a change in the static capacity of the detective capacitor, the wave form of the ignition voltage can be accurately detected at all times. As a result, the presence/absence of misfire can also be detected with high accuracy. Moreover, the detective conductor requires no maintenance once it has been installed.

The aforesaid configuration in which an ignition voltage detection capacitor is integrally formed in the interior of a spark plug cap has numerous advantages over the conventional configuration in which the detective capacitor is formed in the high-voltage cable. However, it has a drawback when actually applied to a spark plug cap intended for volume production.

The simplest method of fabricating a spark plug cap to have the structure described above is to mold the insulator (body) enclosing the high-voltage conductor of insulating resin and at the time of molding the insulator simultaneously embedding the detective conductor in the resin. When this method is used, however, the molding has to be conducted with the detective conductor suspended in the space within the mold. This type of molding is extremely difficult to conduct in actual volume production.

SUMMARY OF THE INVENTION

This invention was accomplished in light of the foregoing circumstances and has as its object to provide a method of forming a spark plug cap with an ignition voltage detective capacitor which enables the spark plug cap to be readily produced in volume without degrading the productivity of the actual mass production process.

For realizing the object,the present invention provides a method of manufacturing a spark plug cap covering a spark plug for an internal combustion engine, equipped with an ignition voltage detective capacitor having, a first conductor for carrying an ignition voltage produced by an ignition coil to the spark plug, an insulative body made of an insulative material and housing the first conductor, and a second conductor located keeping a predetermined distance from the first conductor while sandwiching at least the insulative material such that the capacitor is formed between the first and second conductors for detecting the ignition voltage, comprising the steps of, separately fabricating said insulative body and a member from an insulative material embedding said second conductor therein, and fixing the member at said insulative body such that said detective capacitor is formed.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

FIGS. 1 to 4 show a first embodiment of the invention. This embodiment is applied to a spark plug cap with an integrated ignition coil for use in an ignition system in which a separate ignition coil is provided for the spark plug at each cylinder and the secondary voltage of the ignition coil is supplied directly to the spark plug without the use of a distributor, namely in what is known as the DLI (distributorless ignition) or DI (direct ignition) type ignition system.

Figure 1:
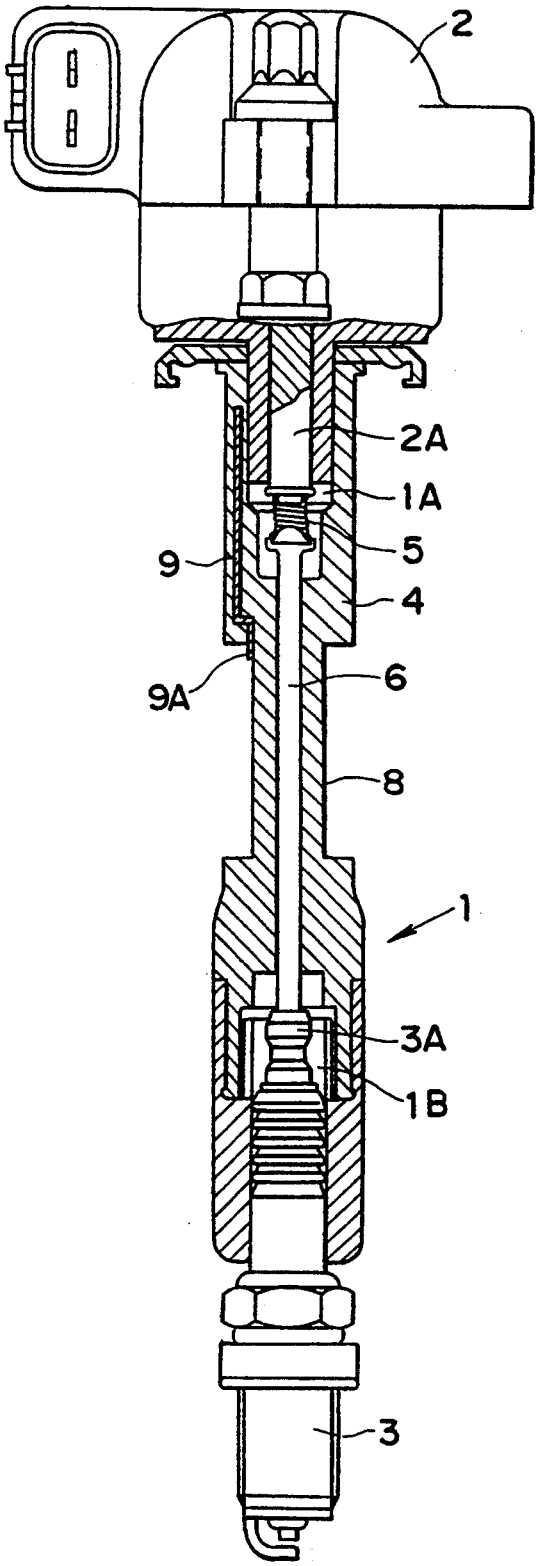
FIG. 1 is a cross sectional view of a spark plug cap with an ignition voltage detective capacitor according to a first embodiment of the invention and fixed with an ignition coil at its top and a spark plug with its bottom.

FIG. 1 shows a spark plug cap 1 not yet formed with a detective capacitor, together with an ignition coil unit 2 and a spark plug 3. The ignition coil unit 2 is fixed to the upper end of the spark plug cap 1. The spark plug cap 1 is integrally formed of polybutylene terephthalate (PBT) or other such hard resin exhibiting excellent heat resistance and electrical insulating property so as to have a generally hollow cylindrical shape. The integrally molded hard resin constitutes an insulative body 4 that will be described below. The upper part of the hollow center portion running in the longitudinal axial direction of the spark plug cap 1 constitutes an upper accommodation chamber 1A for accommodating a secondary output terminal rod 2A of the ignition coil unit 2. The center part thereof accommodates a rod-shaped high-voltage conductor 6 that is electrically connected with the secondary output terminal rod 2A of the ignition coil unit 2 through a conductive spring 5. The lower part thereof constitutes a cap chamber 1B that covers and is fixed to a terminal 3A at the top of the spark plug 3. The lower end of the high-voltage conductor 6 contacts the terminal 3A of the spark plug 3. The high-voltage conductor 6 receives a high voltage for spark discharge from the secondary output terminal rod 2A of the ignition coil unit 2 and conducts it to the terminal 3A of the spark plug 3. The high-voltage conductor 6 is enclosed by the insulative body 4 constituted of hard resin.

A continuous peripheral recessed portion 8 is formed in the outer wall of the insulating body 4 at a position opposite the high-voltage conductor 6 housed inside the insulative body 4. The recessed portion 8 has a sectional profile resembling back-to-back brackets ][. A conductor 9 constituted as a copper lead or a copper wire is embedded for signal transmission in the part of the insulative body 4 above the recessed portion 8 so as to have its tip 9A exposed at the upper inside corner of the recessed portion 8.

The whole of the insulative body 4 of the spark plug cap 1 configured in the above-described manner and shown in FIG. 1 can be integrally molded, and, moreover, the forming of the recessed portion 8 and the embedding of the conductor 9 can be conducted simultaneously with the molding, since the conductor 9 is partially exposed to the surface.

Figure 2:
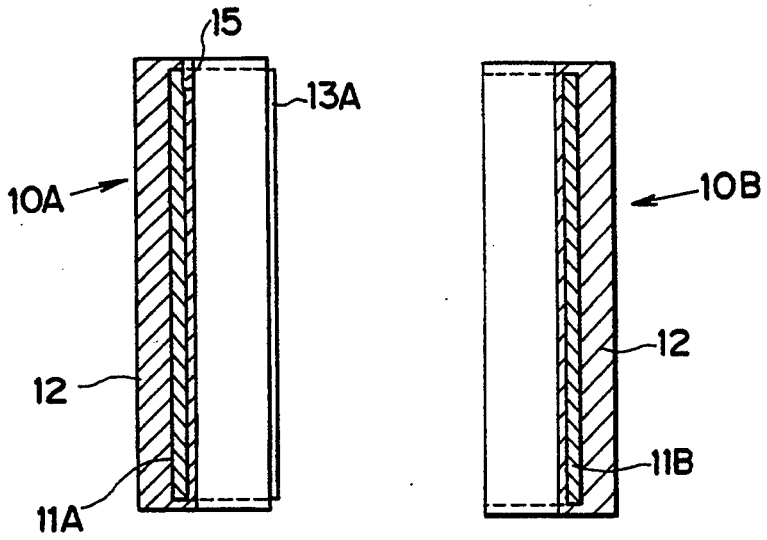
FIG. 2 is an enlarged cross sectional view of split members to be fixed to a recessed portion formed around the spark plug cap illustrated in FIG. 1.
Figure 3:
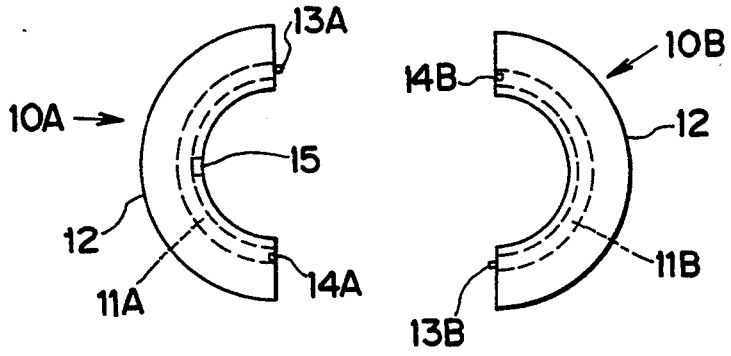
FIG. 3 is a plan view of the split members illustrated in FIG. 2.

FIGS. 2 and 3 show a pair of split members 10A, 10B which are to be embedded in the recessed portion 8 of the insulative body 4 configured in the foregoing manner. Each of the split members 10A, 10B is a semi-cylinder whose inside diameter (radius of curvature of the convex arcuate surface) is substantially the same as that of the indented wall of the recessed portion 8 and whose outside diameter (radius of curvature of the concave arcuate surface) is substantially the same as that of the outer wall of the insulative body 4. Each of the split members 10A, 10B is constituted of an insulative material 12 (which may consist of the same hard resin (e.g., PBT) as the insulative body 4, of some other resin or of rubber or the like) and a semi-cylindrical conductor 11A (11B) made of a good conductor such as copper or aluminum integrally embedded therein. In the illustrated embodiment, the semi-cylindrical conductors 11A, 11B are embedded in the split members 10A, 10B at positions somewhat inward of the centers of the split members 10A, 10B. One end of each semi-cylindrical conductor 11A (11B) is formed with a projection 13A (13B) that protrudes slightly beyond the end of the insulative material 12 and the other end thereof is formed with a small slot 14A (14B) extending slightly into the end of the insulation material 12. The projection 13A (13B) at one end of each semi-cylindrical conductor 11A (11B) can be fitted into the slot 14B (14A) of the semi-cylindrical conductor 11B (11A), when mated. The insulative material 12 of only the split member 10A is provided with a notch 15 at a position to be corresponding to that of the exposed tip 9A of the conductor 9. The semi-cylindrical conductor 11A is exposed at the notch 15.

Figure 4:
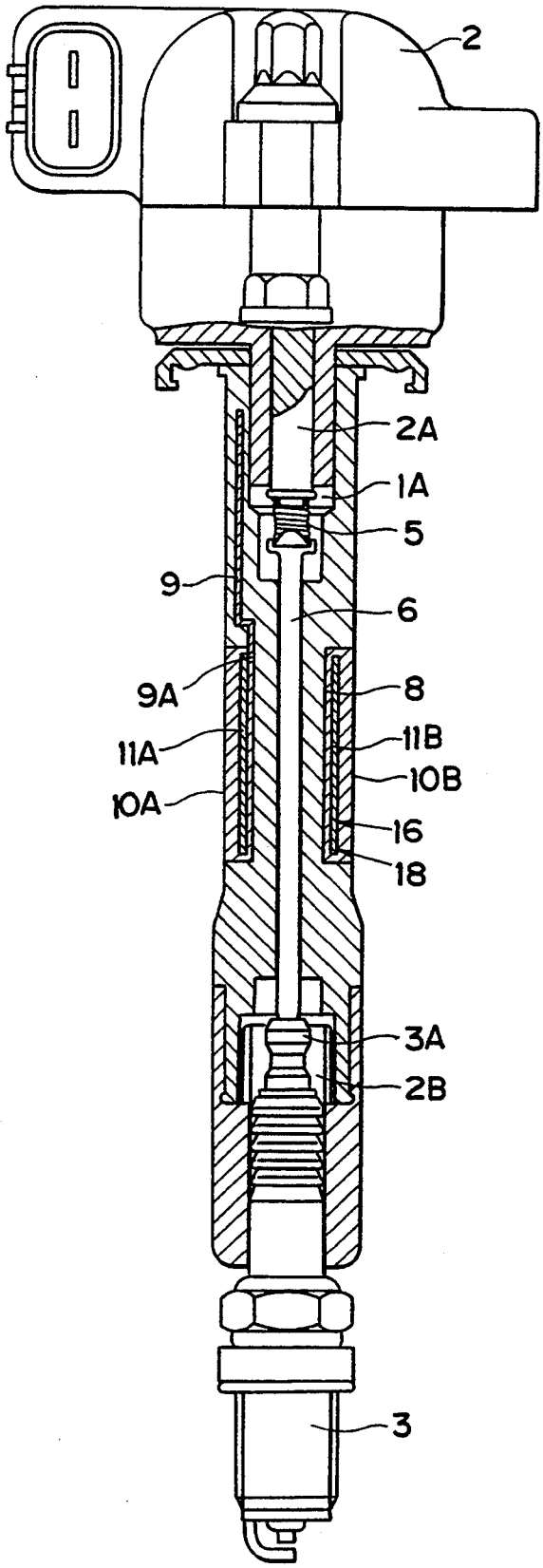
FIG. 4 is a cross sectional view of the spark plug cap illustrated in FIG. 1 and fixed with the split members illustrated in FIGS. 2 and 3 to be completed.

The pair of split members 10A, 10B constituted and configured in the foregoing manner are fabricated by integrally molding the semi-cylindrical conductors 11A, 11B with the insulative material 12, separately from the spark plug cap and fitted into the recessed portion 8 of the insulative body 4, as shown in FIG. 4. After the split members 10A, 10B have been fitted into the recessed portion 8 of the insulative body 4 from opposite sides as shown in FIG. 4, they are fixed to in the recessed portion 8 by fusion under pressure or by bonding with a bonding agent. In the fixed state, the projection 13A (13B) at one end of each semi-cylindrical conductor 11A (11B) is fitted into the slot 14B (14A) of the mated semi-cylindrical conductor 11B (11A) so that the semi-cylindrical conductors 11A, 11B of the split members 10A, 10B are electrically connected and mechanically joined by the coupling of the projections and slots. The ignition coil unit 2 is then fixed and the resulted cap 1 is fixed to the spark plug 3.

As a result, the semi-cylindrical conductors 11A, 11B are electrically joined to form a detective conductor 16 with an overall cylindrical configuration. The detective conductor 16 formed in this manner surrounds the high-voltage conductor 6 as separated therefrom by insulative material (a part of the insulative body 4 and a part of the insulative material 12). This arrangement results in the formation of a detective capacitor 18 between the detective conductor 16 and the high-voltage conductor 6. In addition, the exposed tip 9A of the conductor 9 for signal transmission fits into the notch 15 formed in the split member 10A and makes electrical contact with the semi-cylindrical conductor 11A of the split member 10A. It therefore becomes possible to pass the voltage induced in the detective conductor 16 consisting of the semi-cylindrical conductors 11A, 11B through the conductor 9 to an external signal processing circuit or the like.

FIGS. 5 to 8 show a second embodiment of the invention. This embodiment differs from the first embodiment shown in FIGS. 1 to 4 mainly in that the semi-cylindrical conductors 11A, 11B constituting the detective conductor 16 are electrically shielded from the exterior.

Figure 5:
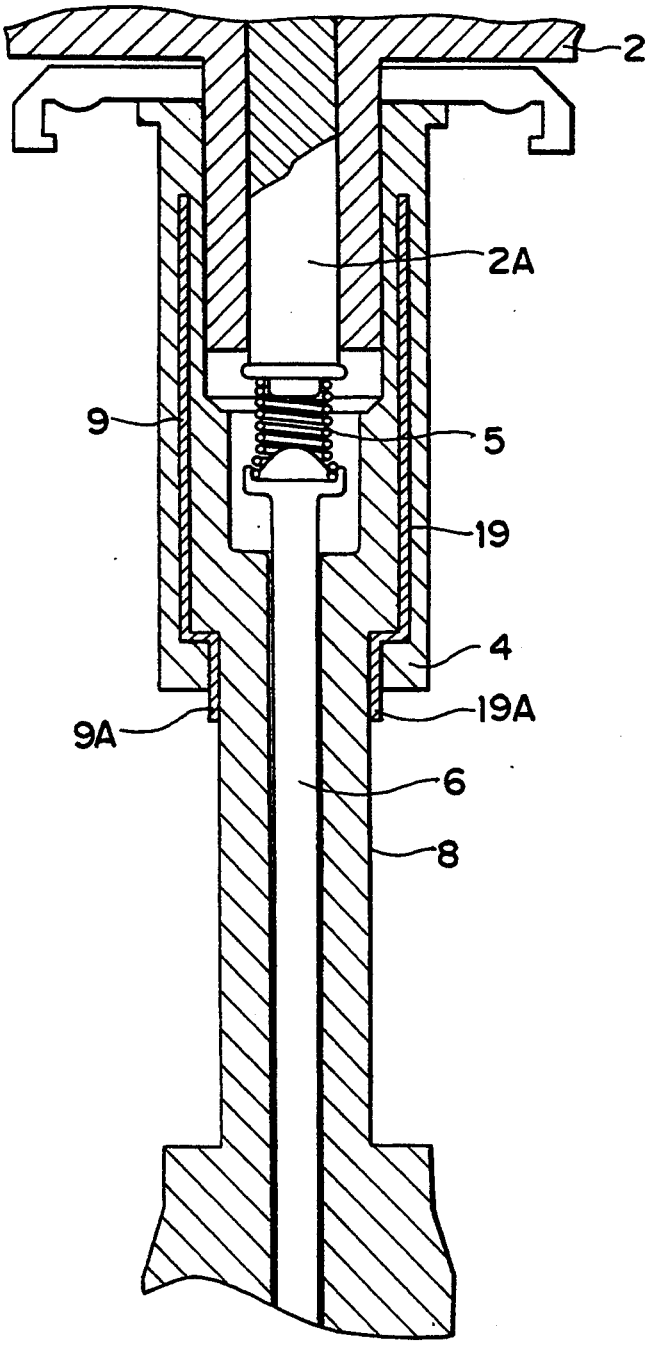
FIG. 5 is a cross sectional view of a portion of a spark plug cap according to a second embodiment of the invention.

As shown in FIG. 5, the structure is similar to that illustrated in FIG. 1 in that the periphery of the insulative body 4 is formed with the recessed portion 8 and that the tip 9A of the conductor 9 embedded in the insulative body 4 is exposed at the recessed portion 8. However, in this embodiment another conductor 19 for grounding, also constituted as a copper lead or a copper wire is embedded in the insulative body 4 at position diametrically opposed to the conductor 9. The tip 19A of the ground potential conductor 19 is also exposed in the recessed portion 8 for the same reasons.

Figure 6:
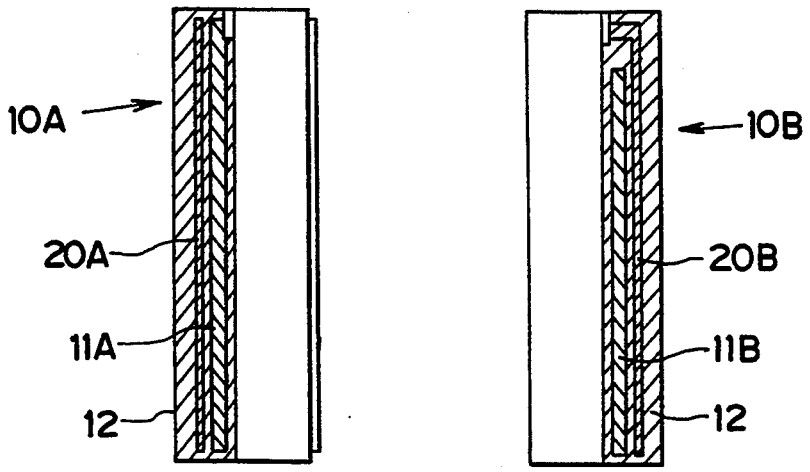
FIG. 6 a view, similar to FIG. 2, but showing split members used in the second embodiment.
Figure 7:
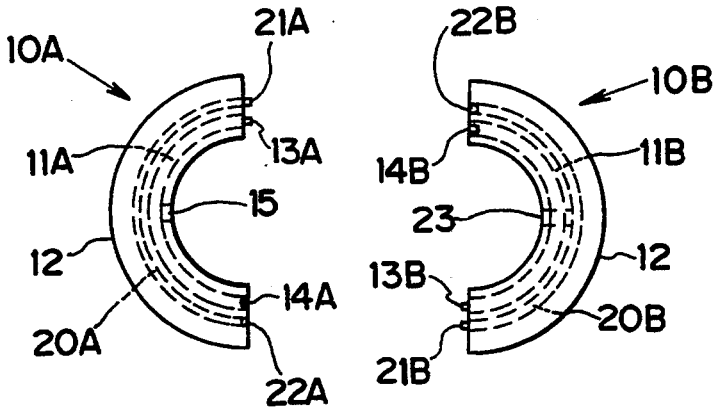
FIG. 7 is a plan view of the split members illustrated in FIG. 6.

As shown in FIGS. 6 and 7, the split members 10A, 10B not only have the semi-cylindrical conductors 11A, 11B embedded therein in the manner described earlier but also have semi-cylindrical shield members 20A, 20B embedded therein. The semi-cylindrical shield members 20A, 20B are formed as plates, foils or screens of a good conductor such as copper or aluminum. They are fabricated as semi-cylinders of a larger radius of curvature than that of the semi-cylindrical conductors 11A, 11B and are disposed outward of the semi-cylindrical conductors 11A, 11B as separated a fixed distance from the outer surfaces thereof by intervening the insulative material 12. Similarly to the semi-cylindrical conductor 11A (11B), one end of each semi-cylindrical shield member 20A (20B) is formed with a projection 21A (21B) that protrudes slightly beyond the end of the insulative material 12 and the other end thereof is formed with a small slot 22A (22B) extending slightly into the end of the insulative material 12. The projection 21A (21B) at one end of each semi-cylindrical shield member 20A (20B) can be fitted into the slot 22B (22A) of the mated semi-cylindrical shield member 20B (20A). Also similarly to the first embodiment illustrated in FIGS. 1 to 4, the notch 15 is formed at a position corresponding to that of the exposed tip 9A of the conductor 9 and the semi-cylindrical conductor 11A is exposed at the notch 15. In addition, a second notch 23 is formed in the split member 10B at a position corresponding to that of the exposed tip 19A of the ground conductor 19 and the semi-cylindrical shield member 20B is exposed at the notch 23.

Figure 8:
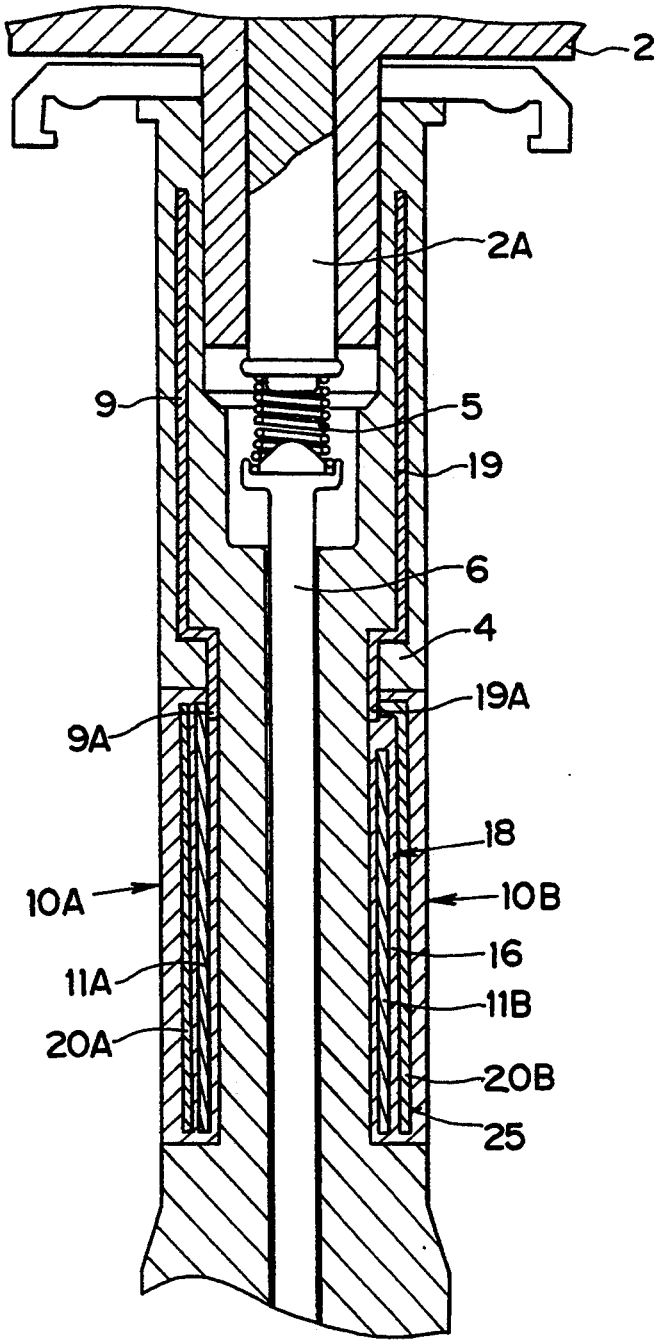
FIG. 8 is a cross sectional view of the spark plug cap according to the second embodiment of the invention illustrated in FIG. 5 and fixed with the split members illustrated in FIGS. 6 and 7 to be completed.

FIG. 8 shows the split members 10A, 10B of FIGS. 6 and 7 fitted into the recessed portion 8 of the insulative body 4 shown in FIG. 5.

As shown in FIG. 8, similarly to the case of FIG. 4, after the split members 10A, 10B have been fabricated separately and fitted into the recessed portion 8 of the insulative body 4 from opposite sides, they are fixed in the recessed portion 8 by fusion under pressure or by bonding with a bonding agent. In the fixed state, the projection 13A (13B) at one end of the semi-cylindrical conductor 11A (11B) is fitted into the slot 14B (14A) of the semi-cylindrical conductor 11B (11A) so that the semi-cylindrical conductors 11A, 11B of the split members 10A, 10B are electrically connected and mechanically joined by the coupling of the projections and slots. As a result, the semi-cylindrical conductors 11A, 11B are electrically joined to form the detective conductor 16 with an overall cylindrical configuration. The detective conductor 16 formed in this manner surrounds the high-voltage conductor 6 as separated therefrom by the insulating material. This arrangement results in the formation of the detective capacitor 18 between the detective conductor 16 and the high-voltage conductor 6. In addition, the projection 21A (21B) at one end of the semi-cylindrical shield member 20A (20B) is fitted into the slot 22B (22A) of the semi-cylindrical shield member 21B (21A) so that the semi-cylindrical shield members 21A, 21B are electrically connected.

As a result, the semi-cylindrical shield members 21A, 21B are electrically joined to form a cylindrical shield 25 completely surrounding the detective conductor 16. Further, the exposed tip 9A of the signal conductor 9 fits into the notch 15 formed in the split member 10A and the exposed tip 19A of the ground potential conductor 19 fits into the notch 23 formed in the split member 10A, whereby the conductor tip 9A makes electrical contact with the semi-cylindrical conductor 11A of the split member 10A and the ground potential conductor tip 19A makes electrical contact with the semi-cylindrical shield members 20B of the split member 10B. It therefore becomes possible to pass the voltage induced in the detective conductor 16 consisting of the semi-cylindrical conductors 11A, 11B through the conductor 9 to an external signal processing circuit or the like and also to maintain the semi-cylindrical shield members 20A, 20B at ground potential by connection to the exterior via the ground potential conductor 19, thereby electrically shielding the detective capacitor 18 constituted by the detective conductor 16 and the high-voltage conductor 6.

By shielding the detective capacitor 18 in this way, it is possible to prevent the accuracy of ignition voltage wave form detection from being degraded as a result of the changes in the detective capacitor's capacitance caused by changes in the distance between itself and some conductive object in the vicinity of the spark plug cap or by noise that the detective capacitor picks up from such a conductive object. As a result, the accuracy of ignition voltage wave form detection can be considerably enhanced.

Figure 9:
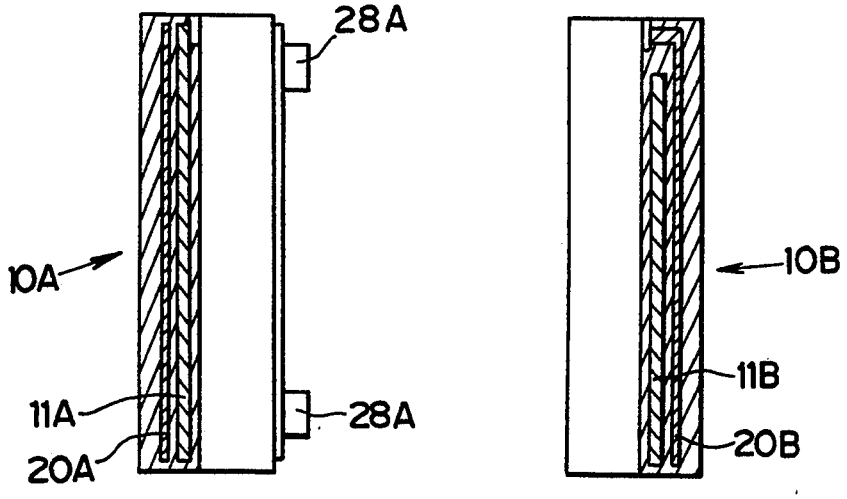
FIG. 9 is an enlarged, cross sectional view of split members to be used in a third embodiment of the invention.
Figure 10:
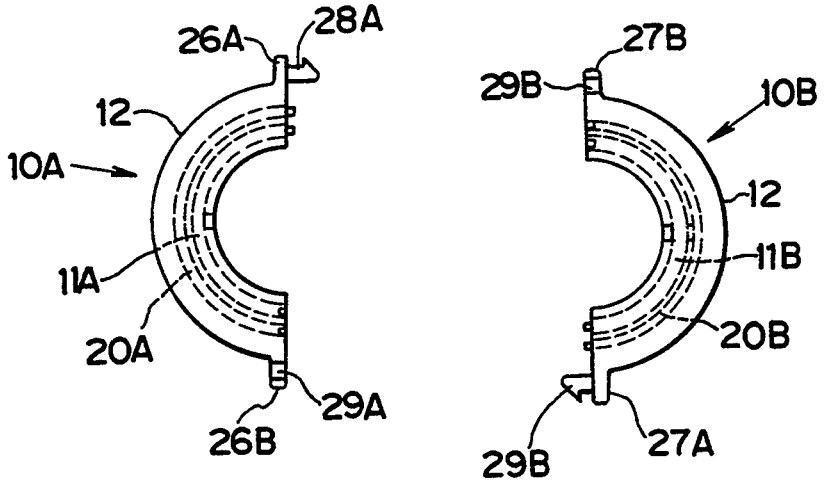
FIG. 10 is a plan view of the split members illustrated in FIG. 9.

FIGS. 9 and 10 show split members 10A, 10B used in a third embodiment of the invention. The split members 10A, 10B are provided at their ends with ribs 26A, 26B; 27A, 27B formed by extending the insulative material 12 portion radially outward. The rib 26A formed at one end of the split member 10A and the rib 27A formed at one of the split member 10B are formed with hooks 28A, 28B, while the rib 26B formed at the other end of the split member 10A and the rib 27B formed at the other end of the split member 10B are formed with holes 29A, 29B for engaging the hooks 28B, 28A. It should here be noted that, although it is not clear from FIG. 10, the ribs are formed at the ends at their upper and lower positions so that the engaging members are provided at the upper and lower positions as will be understood from FIG. 9. The other portions, namely the semi-cylindrical conductors 11A, 11B and the semi-cylindrical shield members 20A, 20B, are the same as those in FIGS. 6 and 7. The ribs 26A, 26B, 27A, 27B, the hooks 28A, 28B, and the holes 29A, 29B are all formed simultaneously with the molding of the insulation material 12.

When the split members 10A, 10B shown in FIGS. 9 and 10 are used, it again suffices to fit them into opposite sides of the recessed portion 8 of the insulative body 4 of the spark plug cap 1 such as shown in FIG. 5. However, in this embodiment, since the hooks 28A, 28B engage with the holes 29B, 29A, the strength of the union between the split members 10A, 10B becomes greater than it would otherwise be. Therefore, the split members 10A, 10B can be securely fixed together even if, for example, the coupling or bonding between the material of the insulative body 4 and the inner surfaces of the split members 10A, 10B should be inferior.

Although the third embodiment was explained with reference to the case where the hooks 28A, 28B etc. are provided on the split members 10A, 10B shown in FIGS. 6 and 7, i.e. on split members 10A, 10B having the semi-cylindrical shield members 20A, 20B, it is also possible to provide similar hooks 28A, 28B on the split members 10A, 10B shown in FIGS. 2 and 3, i.e. on split members 10A, 10B not having the semi-cylindrical shield members.

In all of the foregoing embodiments, the split members 1A, 1B are formed such that the semi-cylindrical conductors 11A, 11B are not exposed at the inner surfaces (concave arcuate surfaces) thereof but are covered by the insulative material 12. Depending on the circumstances, however, the split members 10A, 10B may instead be formed with the semi-cylindrical conductors 11A, 11B exposed at their inner surfaces.

Figure 11:
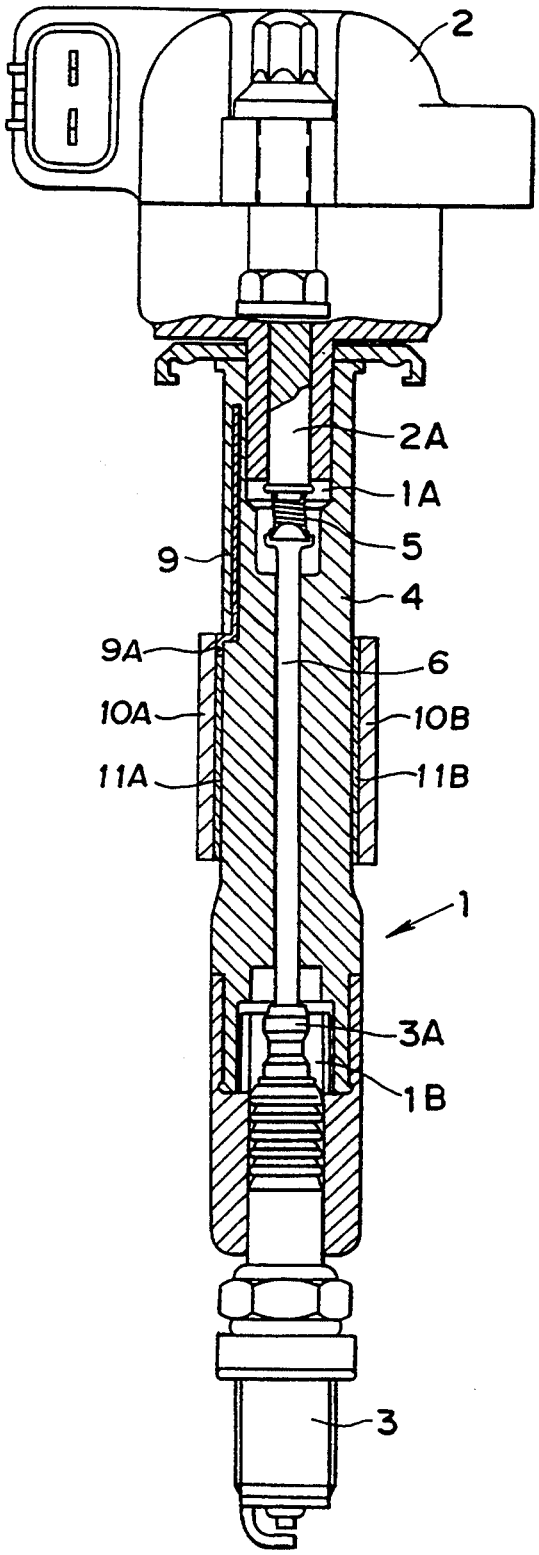
FIG. 11 is a cross sectional view of a spark plug with an ignition voltage detective capacitor according to a fourth embodiment of the invention.

FIG. 11 shows a fourth embodiment of the invention, in which the split member 10A, 10B are formed with the semi-cylindrical conductor 11A, 11B exposed at their inner surfaces. More specifically, the recessed portion 8 is not formed and instead, the split members 10A, 10B are immediately fixed around the insulative body 4 while connecting the tip 9A, exposed to the body surface, of the conductor 9 with the semi-cylindrical conductors 11A, 11B. The rest of the fourth embodiment is the same as the foregoing embodiments. Although the capacitance will be decreased in the embodiment, the purpose of the invention can be achieved and if required, the capacitance will be increased by increasing the conductive area.

Figure 12:
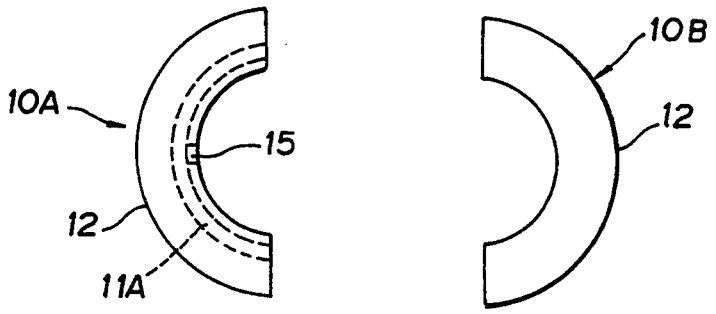
FIG. 12 is a view, similar to FIG. 3, but showing split members used in a fifth embodiment of the invention.

FIG. 12 shows a fifth embodiment of the invention, in which only the split member half 10A is embedded with the semi-cylindrical conductor half 11A. Similar to the fourth embodiment, although the capacitance will be decreased, however, it is possible to restore by increasing the conductive area. The rest of the embodiment is the same as the foregoing embodiments.

Figure 13:
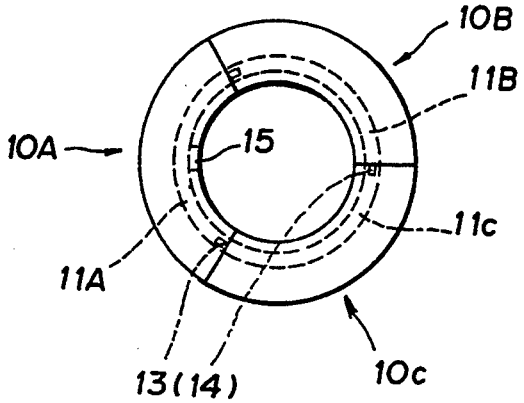
FIG. 13 is a view, similar to FIG. 3, but showing split members used in a sixth embodiment of the invention.

FIG. 13 shows a sixth embodiment of the invention, in which the cylindrical member is divided into three pieces 10A, 10B, 10C each including the semi-cylindrical piece 11A, 11B, 11C which will be joined together by projections 13 and the slots 14. The rest of the embodiment is the same as the foregoing embodiment.

Figure 14:
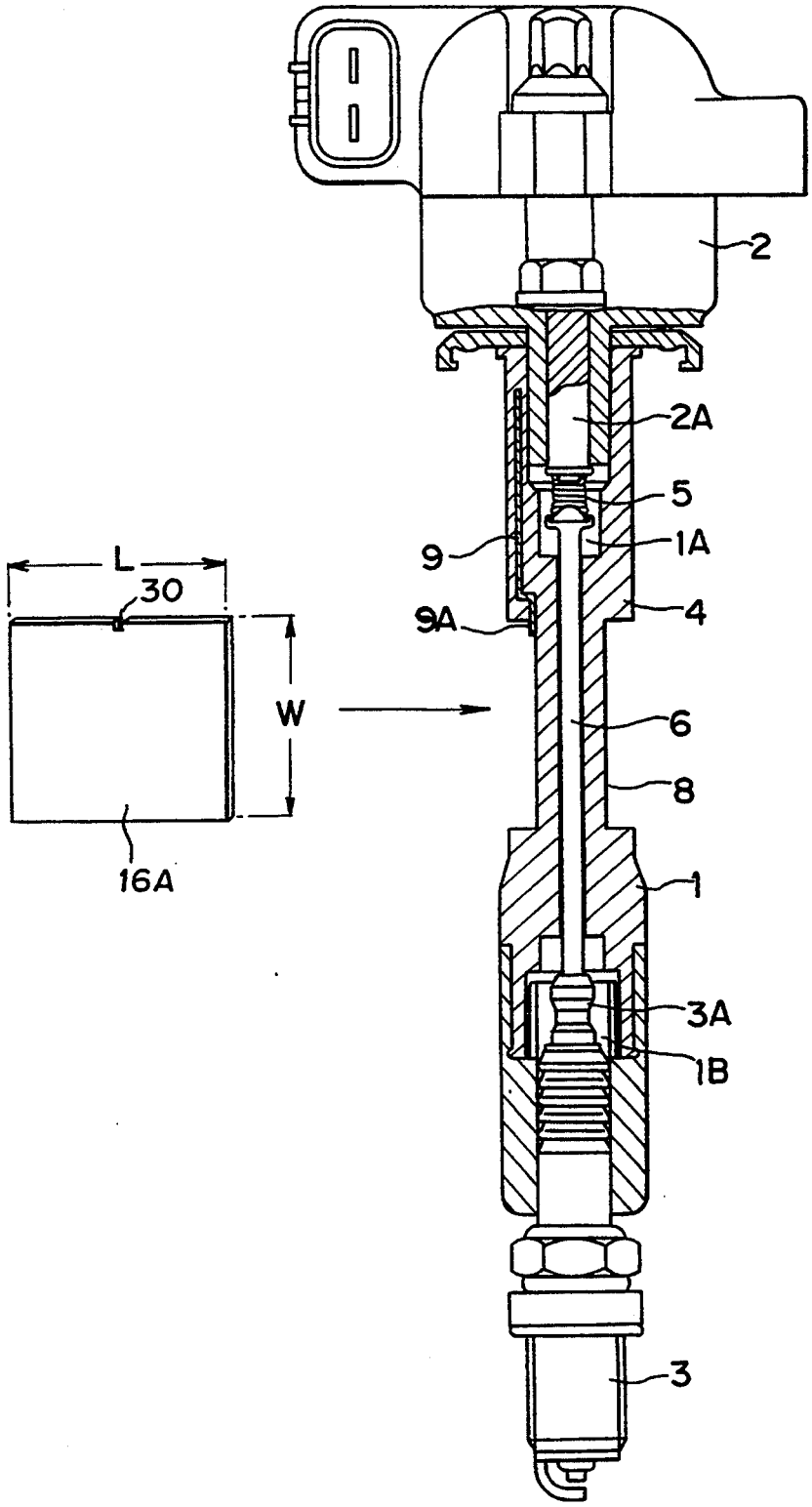
FIG. 14 is a cross sectional view of a spark plug cap and a plate to be wound thereon according to a seventh embodiment of the invention.
Figure 15:
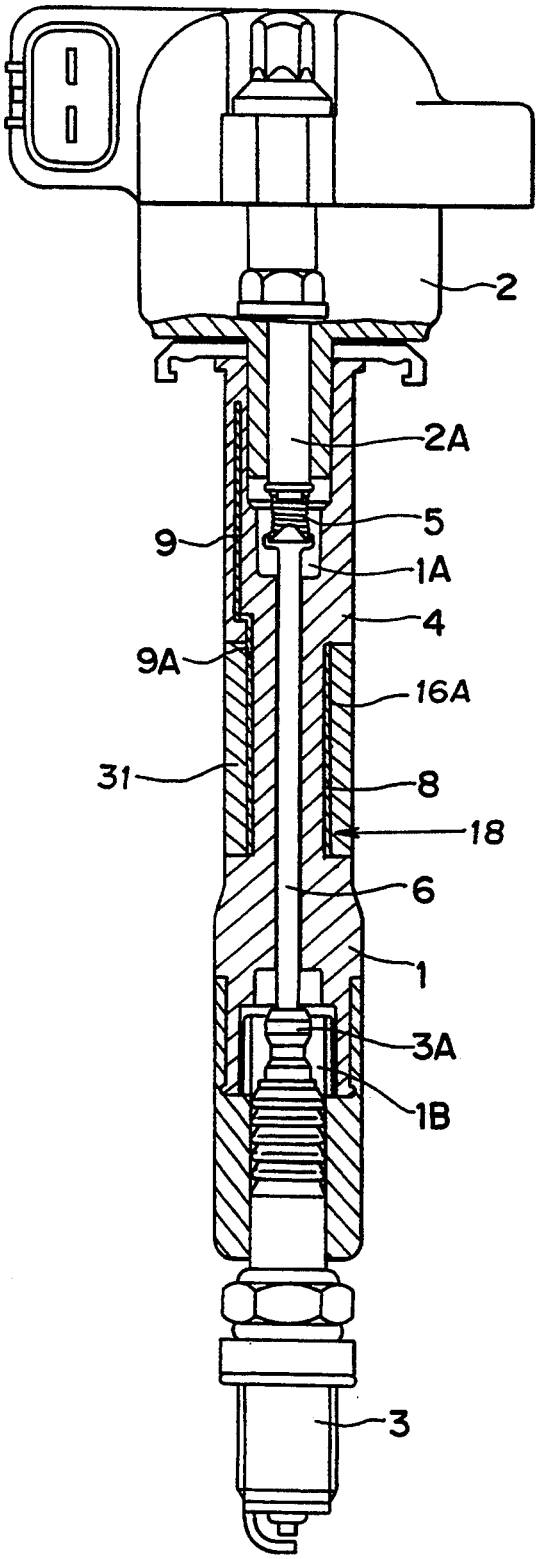
FIG. 15 is a cross sectional view of the spark plug cap according to the seventh embodiment of the invention in which the plate is wound thereon and an insulative material is coated thereon to be completed.
Figure 16:
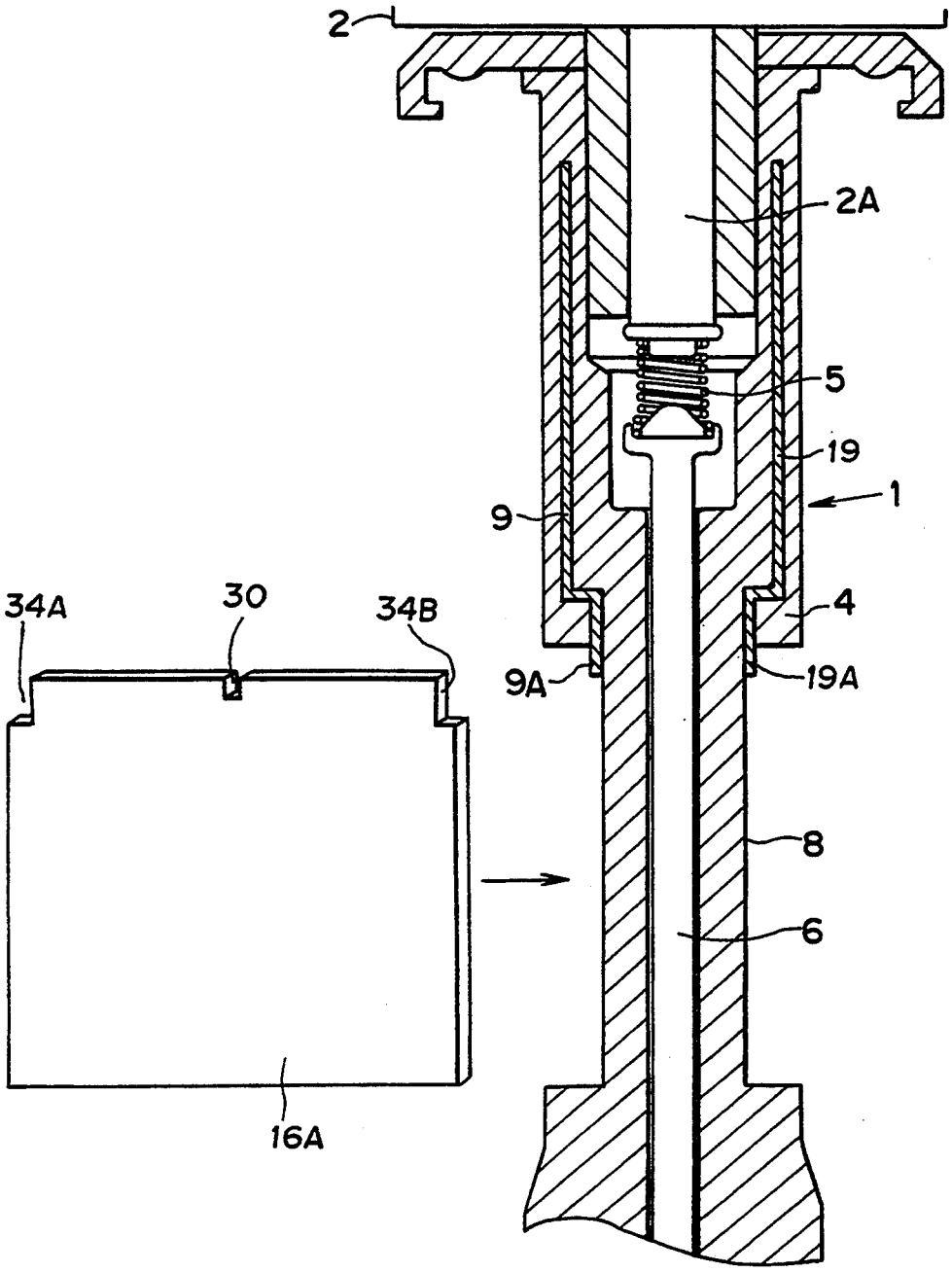
FIG. 16 is a cross sectional view of a portion of a spark plug cap and a plate to be wound thereon according to an eighth embodiment of the invention.

FIGS. 14 and 15 show a seventh embodiment of the invention. This embodiments differs from the first to six embodiments mainly in that the detective conductor 16 is made of a plate 16A to be wound around the recessed portion 8. The plate 16A is made of a conductive material such as copper or aluminum and has a length L approximately identical to the circumference of the indented surface of the recessed portion 8 and a width W equal to or slightly smaller than the width of the indented surface of the recessed portion 8. The plate 16A is provided with a notch 30 at its upper end to be mated with the exposed tip 9A of the conductor 9.

When manufacturing the spark plug cap according to the seventh embodiment, after having fabricating the spark plug cap 1 with the insulator body 4 through molding while embedding the conductor 9 therein in the same manner as the first embodiment, the plate 16A is wound around the indented surface of the recessed portion 8, while receiving the tip 9A of the conductor 9 in the notch 30. Then the wound plate 16A is coated with layer 31 made of the insulative material 12 such as an epoxy resin or a rubber by injection molding so as to insulate the plate 16A from the outside. Thus, the detective capacitor 18 is formed between the high-voltage conductor 6 and the detective conductor 16 (the plate 16A). As illustrated, the layer 31 is preferably thickened such that the recessed portion 8 restores entire flatness over the other surface of the insulative body 4. The insulative body 4 is then fixed with the ignition coil unit 2 at its top and is mounted on the spark plug 3. FIG. 15 shows the fabricated spark plug cap according to the seventh embodiment of the invention.

FIGS. 16 to 19 shows an eighth embodiment of the invention. In the eighth embodiment, the insulator to be applied to the recessed portion outwardly from the plate 16A is constituted as a pair of semi-cylindrical split members 32A, 32B having the semi-cylindrical shield member 20A, 20B embedded therein similar to that used in the second embodiment.

Figure 17:
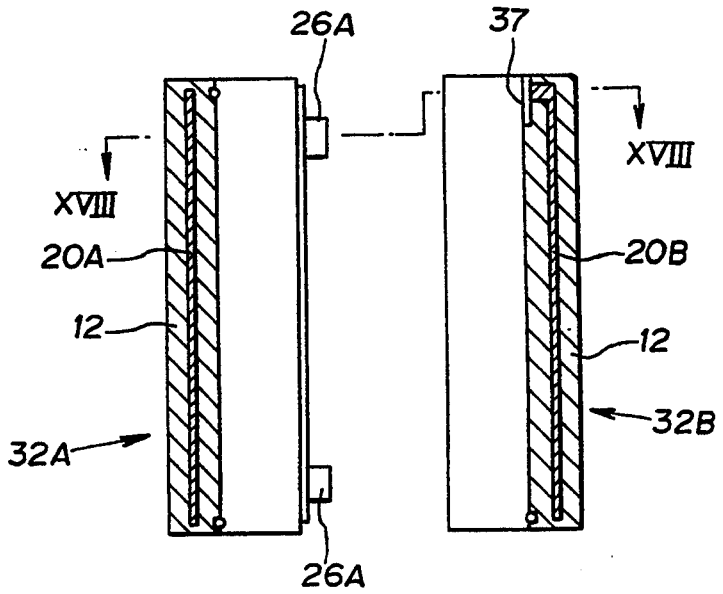
FIG. 17 is an enlarged cross sectional view of split members to be used in the eighth embodiment of the invention.
Figure 18:
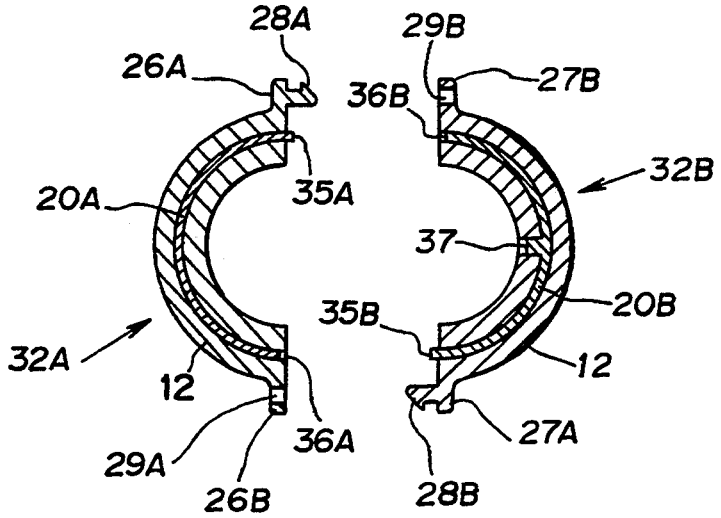
FIG. 18 is a plan view of the split member illustrated in FIG. 17 and taken along the line of XVIII—XVIII thereof.

More specifically, the insulative body 4 is provided with the second conductor 19 for grounding at the position diametrically opposed to the conductor 9 exposing its tip 19A in the recessed portion. The plate 16A is cut out at the both sides of the upper end to form recesses 34A, 34B which are faced together, when the plate 16A is wound around the recessed portion 8, to form a cutaway so as to accommodate the tip 19A of the second conductor 19 which will be in contact with a projection 37 projecting from the shield member 20B. Similarly to the third embodiment, the split members 32A, 32B are provided with ribs 26A, 26B; 27A, 27B having hooks 28A, 28B and holes 29A, 29B to be engaged therewith as illustrated in FIGS. 17 and 18.

Figure 19:
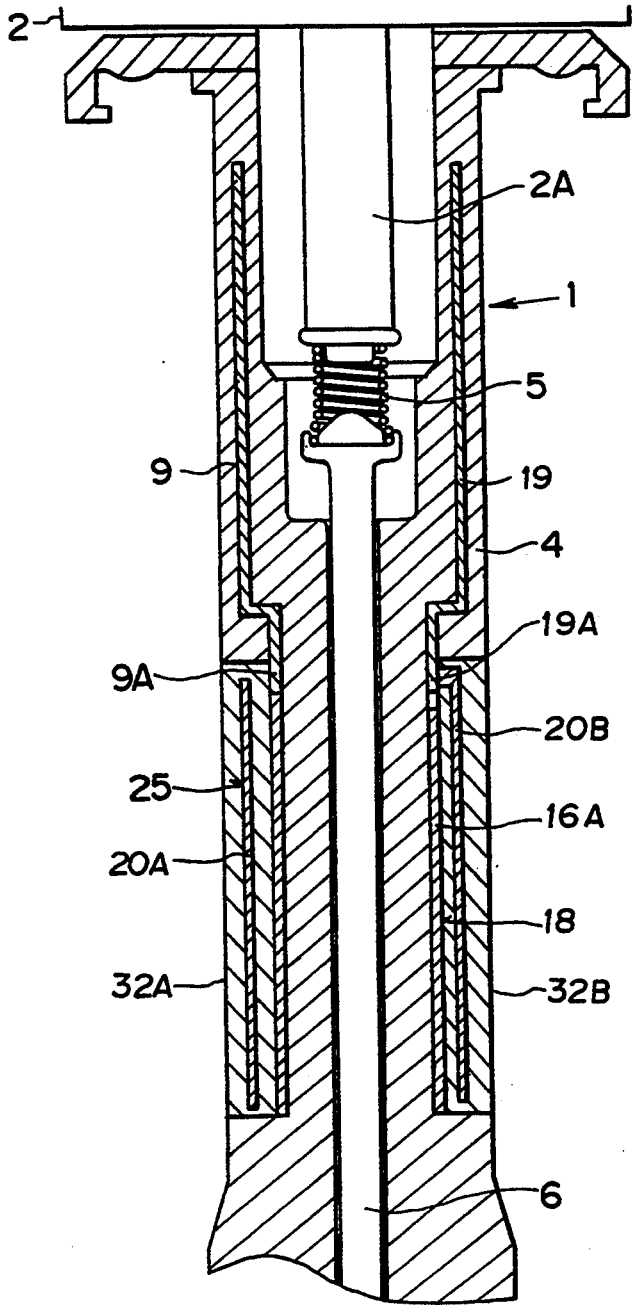
FIG. 19 is a cross sectional view of the spark plug cap according to the eighth embodiment of the invention with the plate wound thereon and the split members fixed thereon to be completed.

When manufacturing the spark plug cap with the detective capacitor in the eighth embodiment, the split members 32A, 32B are first molded or formed by embedding the shield members 20A, 20B in the insulative material 12. Then, the plate 16A is wound around the recessed portion 8 of the prefabricated insulative body 4, and the split members 32A, 32B are fitted on the wounded plate 16A engaging the hooks 28A, 28B in the holes 29A, 29B. FIG. 19 shows this. It is alternative possible to additionally use a bonding agent to increase the strength of the union between the split members, to omit the hook and hole engagement if the split members can be firmly secured in position by fusion under pressure or by bonding with a bonding agent.

Figure 20:
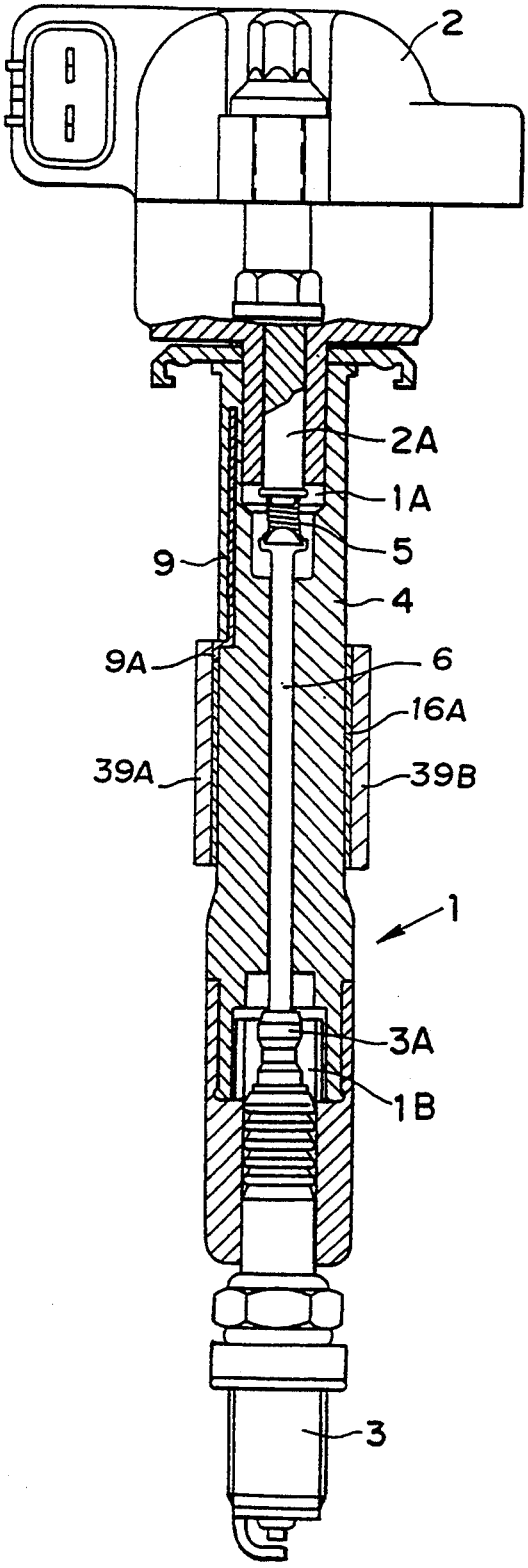
FIG. 20 is a view, similar to FIG. 15, but showing a spark plug cap with an ignition voltage detective capacitor according to a ninth embodiment of the invention.
Figure 21:
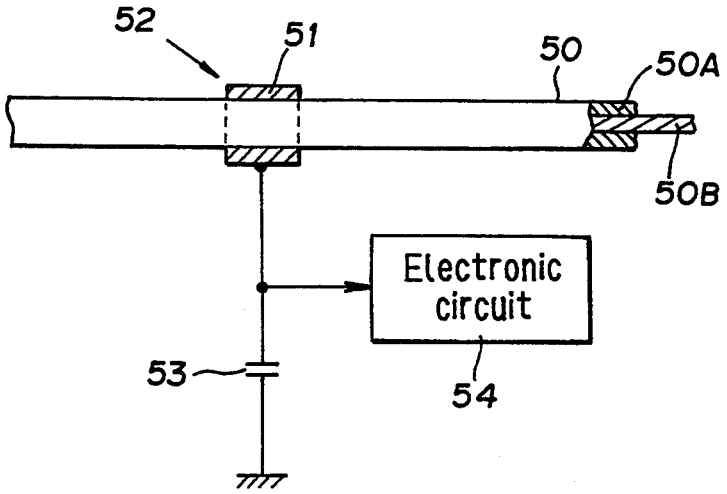
FIG. 21 is a view explaining a prior art misfire detector.

FIG. 20 shows a ninth embodiment of the invention, in which, similarly to the fourth embodiment, the recessed portion 8 is not provided and instead, the plate 16A is immediately wound around the insulative body 4 and a pair of split members 39A, 39B are then fixed thereon. The rest of the embodiment is the same as the foregoing embodiment.

It should be noted that although the cylindrical split members with/without a conductor and/or a shield member is used, since the gist of the invention is to fabricate the insulative body and the other components separately and fix them together, only a segment of the split member can instead be used.

It should further be that, although the cylindrical member 10, 32, 39 are divided into two or three pieces, it is alternatively possible to cut into four or more pieces.

It should furthermore be noted that the recessed portion 8 of the insulative body is provided at the molding or forming of the body, it is alternatively possible to mold or form the body without the recessed portion and then to provide the portion by cutting or machining.

It should yet furthermore be noted that the invention can of course also be applied to the cap of a spark plug used in an ignition system employing an ignition distributor, namely to the cap of the a spark plug which does not have an ignition coil formed integrally therewith.

The present invention has thus been shown and described with reference to the specific embodiments. However, it should be noted that the present invention is in no way limited to the details of the described arrangements; changes and modifications may be made without departing from the scope of the appended claims.

What is claimed is:

1. A method of manufacturing a spark plug cap covering a spark plug for an internal combustion engine, equipped with an ignition voltage detective capacitor having;

a first conductor for carrying an ignition voltage produced by an ignition coil to the spark plug;

an insulative body made of an insulative material and housing the first conductor; and a second conductor located a predetermined fixed distance from the first conductor while sandwiching at least the insulative material such that the capacitor is formed between the first and second conductors for detecting the ignition voltage;

comprising the steps of;

fabricating said insulative body separately fabricating a member from an insulative material embedding said second conductor therein; and fixing the member to said insulative body such that said detective capacitor is formed.

2. The method according to claim 1, further including the steps of:

fabricating said member in the shape of a plurality of pieces of a cylindrical member from the insulative material embedding said second conductor and divided longitudinally such that at least one of the pieces of the cylindrical member includes said second conductor; and fixing the pieces of the cylindrical member around said fabricated insulative body such that said detective capacitor is formed.

3. The method according to claim 2, wherein each of said plurality of pieces of the cylindrical member includes a piece of said second conductor.

4. The method according to claim 3, wherein said pieces of said second conductor have a contact to be electrically connected with each other when fixed around said insulative body.

5. The method according to claim 2, wherein separately fabricating said insulative body includes embedding a third conductor therein which exposes its tip to the exterior and said member embedding said second conductor and formed with a notch such that the notch receives the tip of the third conductor to be engaged with said second conductor when fixed around said insulative body for transmitting the detected ignition voltage to the exterior through the third conductor.

6. The method according to claim 2, wherein each of said plurality of pieces of said cylindrical member is provided with an engaging member such that said plurality of pieces of said cylindrical member are engaged with each other when foxed around the insulative body.

7. The method according to claim 6, wherein the engaging member comprises a hook and a hole receiving the hook.

8. The method according to claim 2, wherein fabricating said plurality of pieces of said cylindrical member includes embedding a shield with said second conductor such that the shield member is located outside of said second conductor when fixed around said fabricated insulative body.

9. The method according to claim 1, further including the steps of:

separately fabricating said insulative body having an annular recess formed about its circumference and said member in the shape of a plurality of pieces of a cylindrical member from the insulative material embedding said second conductor and divided longitudinally such that at least one of the pieces of the cylindrical member includes said second conductor, the inner diameter of the cylindrical member being not less than the diameter of an inner surface of the annular recess formed about the insulative body; and fixing the pieces of the cylindrical member in the annular recess formed about the insulative body such that said detective capacitor is formed.

10. The method according to claim 9, wherein each of said plurality of pieces of the cylindrical member includes a piece of said second conductor.

11. The method according to claim 10, wherein each said piece of said second conductor has a contact to be electrically connected with an adjacent contact when fixed around said insulative body.

12. The method according to claim 9, wherein fabricating said plurality of pieces of said cylindrical member includes embedding a shield with said second conductor such that the shield member is located outside of said second conductor when fixed in the annular recess formed about said insulative body.

13. The method according to claim 9, wherein separately fabricating said insulative body includes embedding a third conductor therein which exposes its tip to the exterior and said member embedding said second conductor formed with a notch such that the notch receives the tip of the third conductor to be engaged with said second conductor when fixed in the annular recess formed about said insulative body for transmitting the detected ignition voltage to the exterior through the third conductor.

14. The method according to claim 9, wherein each of said plurality of pieces of said cylindrical member is provided with an engaging member such that said plurality of pieces of said cylindrical member are engaged with each other when fixed in the recess formed about the insulative body.

15. The method according to claim 14, wherein the engaging member comprises a hook and a hole receiving the hook.

16. The method according to claim 1, wherein fabricating said member includes embedding a shield member with said second conductor such that the shield member is located outside of said second conductor when fixed to said insulative body.

17. The method according to claim 1, wherein separately fabricating said insulative body includes embedding a third conductor therein which exposes its tip to the exterior and said member embedding said second conductor and formed with a notch such that the notch receives the tip of the third conductor to be engaged with said second conductor when fixed to said insulative body for transmitting the detected ignition voltage to the exterior through the third conductor.

18. A method of manufacturing a spark plug cap covering a spark plug for an internal combustion engine, equipped with an ignition voltage detective capacitor having;

a first conductor for carrying an ignition voltage produced by an ignition coil to the spark plug;

an insulative body made of an insulative material and housing the first conductor; and a second conductor located a predetermined fixed distance from the first conductor while sandwiching the insulative material such that the capacitor is formed between the first and second conductors for detecting the ignition voltage;

comprising the steps of;

fabricating said insulative body, said second conductor in the shape of a plate and separately fabricating a member from an insulative material;

winding the second conductor around said insulative body; and fixing the member to said insulative body on the second conductor such that said detective capacitor is formed.

19. The method according to claim 18, wherein fabricating said member in the shape of a plurality of pieces of a cylindrical member from the insulative material divided longitudinally; and fixing the pieces of the cylindrical member to said fabricated insulative body around said second conductor such that said detective capacitor is formed.

20. The method according to claim 19, wherein fabricating said plurality of pieces of said cylindrical member includes embedding a shield such that the shield member is located outside of said second conductor when fixed to said fabricated insulative body.

21. The method according to claim 19, wherein separately fabricating said insulative body includes embedding a third conductor therein which exposes its tip to the exterior and said second conductor formed with a notch such that the notch receives the tip of the third conductor to be engaged with said second conductor when fixed around said insulative body for transmitting the detected ignition voltage to the exterior through the third conductor.

22. The method according to claim 19, wherein each of said plurality of pieces of said cylindrical member is provided with an engaging member such that said plurality of pieces of said cylindrical member are engaged with each other when fixed about the insulative body.

23. The method according to claim 22, wherein the engaging member comprises a hook and a hole receiving the hook.

24. The method according to claim 18; wherein separately fabricating said insulative body having an annular recess formed its circumference, said second conductor in the shape of a plate and said member in the shape of a plurality of pieces of a cylindrical member from the insulative material divided longitudinally, the inner diameter of the cylindrical member being not less than the diameter of an indented surface of the recess formed at the insulative body;

winding said second conductor around the annular recess; and fixing the pieces of the cylindrical member in the annular recess formed about the insulative body around said second conductor such that said detective capacitor is formed.

25. The method according to claim 24, wherein fabricating said plurality of pieces of said cylindrical member includes embedding a shield such that the shield member is located outside of said second conductor when fixed in the annular recess formed about said insulative body.

26. The method according to claim 24, wherein separately fabricating said insulative body includes embedding a third conductor therein which exposes its tip to the exterior and said second conductor formed with a notch such that the notch receives the tip of the third conductor to be engaged with said second conductor when fixed in the annular recess formed about said insulative body for transmitting the detected ignition voltage to the exterior through the third conductor.

27. The method according to claim 24, wherein each of said plurality of pieces of said cylindrical member is provided with an engaging member such that said plurality of pieces of said cylindrical member are engaged with each other when fixed about the insulative body.

28. The method according to claim 27, wherein the engaging member comprises a hook and a hole receiving the hook.

29. The method according to claim 18, wherein fabricating said member includes embedding a shield member such that the shield member is located outside of said second conductor when fixed around said insulative body.

30. The method according to claim 18 wherein separately fabricating said insulative body includes embedding a third conductor therein which exposes its tip to the exterior and said second conductor formed with a notch such that the notch receives the tip of the third conductor to be engaged with said second condcutor when fixed around said insulative body for transmitting the detected ignition voltage to the exterior through the third conductor.

* * * * *